US010875087B1

(12) United States Patent
Bodeau et al.

(10) Patent No.: US 10,875,087 B1
(45) Date of Patent: Dec. 29, 2020

(54) SYSTEM, APPARATUS, AND METHOD FOR MOLD STARTER BLOCK ALIGNMENT

(71) Applicant: WAGSTAFF, INC., Spokane Valley, WA (US)

(72) Inventors: Loren Keith Bodeau, Spokane Valley, WA (US); Craig Richard Cordill, Spokane Valley, WA (US); Brett Allan Thielman, Spokane Valley, WA (US)

(73) Assignee: WAGSTAFF, INC., Spokane Valley, WA (US)

( * ) Notice: Subject to any disclaimer, the term of this patent is extended or adjusted under 35 U.S.C. 154(b) by 0 days.

(21) Appl. No.: 16/796,418

(22) Filed: Feb. 20, 2020

(51) Int. Cl.
*B22D 11/08* (2006.01)

(52) U.S. Cl.
CPC ..... *B22D 11/083* (2013.01); *B22D 11/08* (2013.01); *B22D 11/081* (2013.01)

(58) Field of Classification Search
CPC ..... B22D 11/08–088
See application file for complete search history.

(56) References Cited

U.S. PATENT DOCUMENTS

| | | | | |
|---|---|---|---|---|
| 3,957,105 | A * | 5/1976 | Foye | B22D 11/049 164/425 |
| 5,634,511 | A * | 6/1997 | Steen | B22D 11/08 164/425 |
| 5,647,427 | A * | 7/1997 | Collins | B22D 11/04 164/418 |
| 2011/0315339 | A1* | 12/2011 | Naess, Jr. | B22D 11/05 164/436 |

* cited by examiner

*Primary Examiner* — Kevin E Yoon
(74) *Attorney, Agent, or Firm* — Alston & Bird LLP

(57) ABSTRACT

Provided herein is a system, apparatus, and method for aligning a continuous casting mold and a starter block. The continuous casting mold alignment system may include: a continuous casting mold; a mold frame supporting the continuous casting mold; a starter block; and at least one bearing assembly. The at least one bearing assembly is movable between a lowered position and a raised position, where the at least one bearing assembly, in the raised position, engages and supports one of the continuous casting mold or the starter block. The at least one bearing assembly, in the raised position, enables the one of the continuous casting mold or the starter block to be moved into alignment with the other of the continuous casting mold or the starter block by a force below a predefined threshold.

20 Claims, 16 Drawing Sheets

SYSTEM, APPARATUS, AND METHOD FOR MOLD STARTER BLOCK ALIGNMENT

TECHNOLOGICAL FIELD

The present disclosure relates to a system, apparatus, and method for aligning a continuous casting mold and a starter block, and more particularly, to alignment of a mold starter block alignment with a continuous casting mold whereby the starter block or the continuous casting mold is movable relative to the mold during alignment, and locked down upon alignment between the mold and the starter block.

BACKGROUND

Metal products may be formed in a variety of ways; however numerous forming methods first require an ingot, billet, or other cast part that can serve as the raw material from which a metal end product can be manufactured, such as through rolling or machining, for example. One method of manufacturing an ingot or billet is through a continuous casting process known as direct chill casting, whereby a vertically oriented mold cavity is situated above a platform that translates vertically down a casting pit. A starter block may be situated on the platform and form a bottom of the mold cavity, at least initially, to begin the casting process. Molten metal is poured into the mold cavity whereupon the molten metal cools, typically using a cooling fluid. The platform with the starter block thereon may descend into the casting pit at a predefined speed to allow the metal exiting the mold cavity and descending with the starter block to solidify. The platform continues to be lowered as more molten metal enters the mold cavity, and solid metal exits the mold cavity. This continuous casting process allows metal ingots and billets to be formed according to the profile of the mold cavity and having a length limited only by the casting pit depth and the hydraulically actuated platform moving therein.

Alignment between the starter block and the mold cavity is important to reduce molten metal leaks during the initial casting start up phase and to minimize damage to either the mold cavity walls or the starter block when the two are brought together ahead of the casting process.

BRIEF SUMMARY

The present disclosure relates to a system, apparatus, and method for aligning a continuous casting mold and a starter block, and more particularly, to alignment of a mold starter block alignment with a continuous casting mold whereby the starter block or the continuous casting mold is movable relative to the mold during alignment, and locked down upon alignment between the mold and the starter block. Embodiments described herein may provide a continuous casting mold alignment system including: a continuous casting mold; a mold frame supporting the continuous casting mold; a starter block; and at least one bearing assembly. The at least one bearing assembly is movable between a lowered position and a raised position, where the at least one bearing assembly, in the raised position, engages and supports one of the continuous casting mold or the starter block. The at least one bearing assembly, in the raised position, enables the one of the continuous casting mold or the starter block to be moved into alignment with the other of the continuous casting mold or the starter block by a force below a predefined threshold. In the lowered position, the at least one bearing assembly disengages the one of the continuous casting mold and the starter block, where in response to the at least one bearing assembly being in the lowered position, the one of the continuous casting mold or the starter block cannot be moved by a force below the predefined threshold.

According to some embodiments, the system may include at least one pneumatic cylinder, where the at least one bearing assembly is moved between the raised position and the lowered position by the at least on pneumatic cylinder. Systems may include an alignment guide arranged between the starter block and the continuous casting mold, where the alignment guide causes movement of the one of the starter block or the continuous casting mold relative to the other of the starter block or the continuous casting mold in response to the one of the starter block or the continuous casting mold being supported by the at least one bearing assembly and the starter block engaging the continuous casting mold. The alignment guide may include a tapered pin and a receiver, where the movement of the starter block may be performed as the tapered pin engages the receiver.

According to an example embodiment in which the at least one of the continuous casting mold and the starter block being the starter block, embodiments of the system may include a platform defining a support surface, where in response to the at least one bearing assembly being in the lowered position, the starter block is supported by the support surface, and where in response to the at least one bearing assembly being in the raised position, the starter block is supported by the at least one bearing assembly. In response to the at least one bearing assembly being disposed in the raised position, the starter block supported by the bearing assembly is movable in two orthogonal directions relative to the platform in response to forces along either direction of a first vale, where in response to the at least one bearing assembly being disposed in the lowered position, the starter block is supported by the starter block support surface and is not movable in the two orthogonal directions relative to the platform in response to forces along either direction of the first value. Embodiments may include a clamp to engage the starter block, where in response to the at least one bearing assembly being moved to the lowered position, the clamp applies a force to the starter block. In response to application of force from the clamp, a force of the starter block against the support surface is greater than a weight of the starter block.

According to an example embodiment in which the at least one of the continuous casting mold and the starter block being the continuous casting mold, the bearing assembly may be supported by the mold frame. The at least one bearing assembly, in the raised position, engages and supports the mold, where the mold is movable relative to the starter block for alignment of the mold with the starter block. The bearing assembly may include a clamping block, where in response to the bearing assembly moving from the raised position to the lowered position, the clamping block secures the continuous casting mold to the mold frame. In response to the bearing assembly being in the raised position, the continuous casting mold may be movable in two orthogonal directions in response to forces in the two orthogonal directions of a first value, where in response to the bearing assembly being in the lowered position, the continuous casting mold is not movable in the two orthogonal directions in response to forces in the two orthogonal directions of the first value.

Embodiments described herein may provide a method of aligning a continuous casting mold with a starter block including: advancing at least one bearing assembly to a raised position, where the at least one bearing assembly, in the raised position, engages and supports one of the continuous casting mold or the starter block; aligning the one of the continuous casting mold or the starter block with the other of the continuous casting mold or the starter block; and retracting the at least one bearing assembly to a lowered position, where the at least one bearing assembly, in the lowered position, is disengaged from the one of the continuous casting mold or the starter block. In response to the one of the continuous casting mold or the starter block being engaged by and supported by the at least one bearing assembly, forces along two orthogonal directions below a first value move the one of the continuous casting mold or the starter block relative to the at least one bearing assembly. In response to the one of the continuous casting mold or the starter block being disengaged by the at least one bearing assembly, forces along two orthogonal directions below the first value do not move the one of the continuous casting mold or the starter block relative to the at least one bearing assembly.

The aligning of the continuous casting mold or the starter block with the other of the continuous casting mold or the starter block may include moving the one of the continuous casting mold or the starter block along two orthogonal directions relative to the other of the continuous casting mold or the starter block. Moving the one of the continuous casting mold or the starter block along two orthogonal directions relative to the other of the continuous casting mold or the starter block may be performed by an alignment guide arranged between the starter block and the continuous casting mold. Methods may include clamping the one of the continuous casting mold or the starter block in a secured position in response to retracting the at least one bearing assembly to the lowered position.

In an example embodiment in which the one of the continuous casting mold or the starter block is the continuous casting mold, clamping the continuous casting mold in the secured position in response to retracting the at least one bearing assembly to the lowered position may include clamping the continuous casting mold to a mold frame. In an example embodiment in which the one of the continuous casting mold or the starter block is the starter block, clamping the starter block in the secured position in response to retracting the at least one bearing assembly to the lowered position includes clamping the starter block to a platform in a casting pit of a continuous casting mold system.

Embodiments described herein may include an alignment system for aligning a starter block with a continuous casting mold. The alignment system may include: a bearing assembly including at least one bearing having a bearing surface; a lifting mechanism where the lifting mechanism is configured to move the bearing assembly between a lowered position in which the bearing surface is recessed below a support surface and a raised position in which the bearing surface is proud of the support surface; and a clamping mechanism to secure one of a starter block or a continuous casting mold to a starter block support surface or a mold frame, respectively. The lifting mechanism may include a pneumatic cylinder. The bearing assembly, in the raised position, may be configured to support the starter block and enable the starter block to be moved relative to the continuous casting mold with a force substantially lower than a force required with the bearing assembly in the lowered position. The bearing assembly, in the raised position, may be configured to support the continuous casting mold and enable the continuous casting mold to be moved relative to the starter block with a force substantially lower than a force required with the bearing assembly in the lowered position.

BRIEF DESCRIPTION OF THE DRAWINGS

Figure 1:
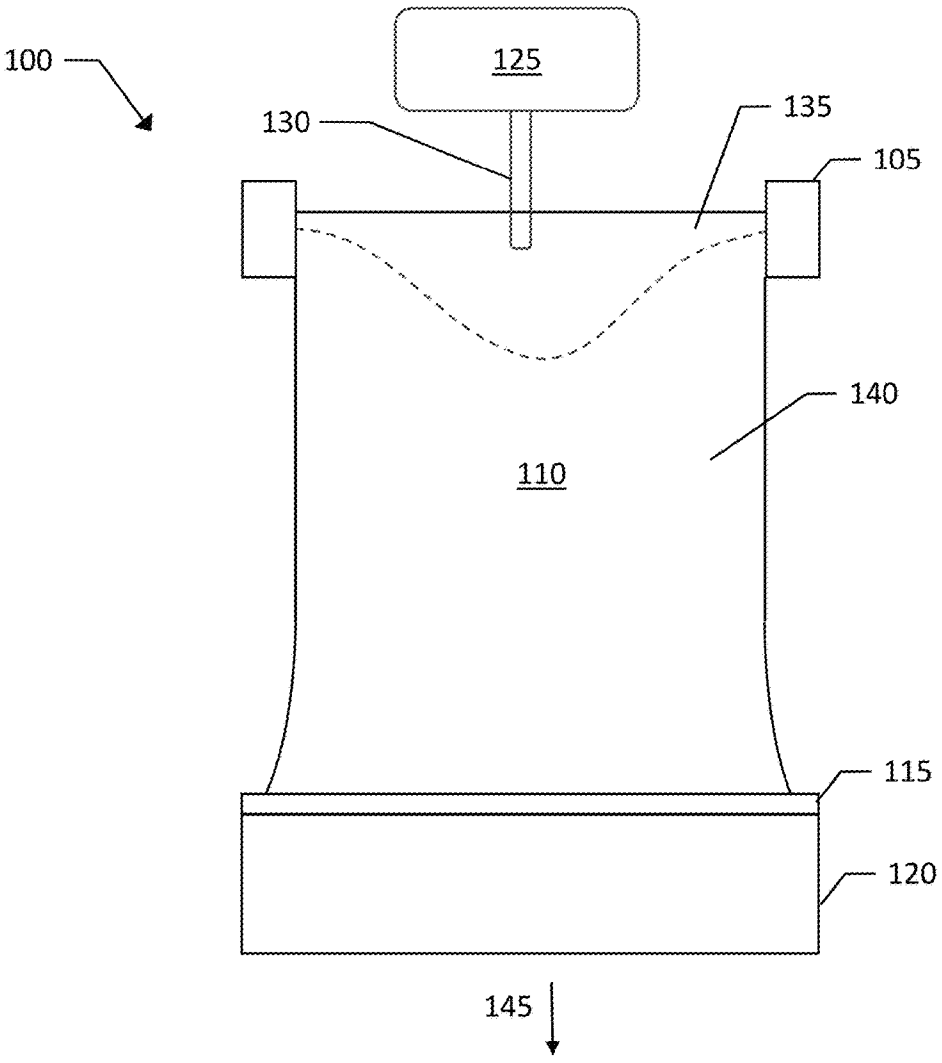
FIG. 1 (PRIOR ART)
Figure 2:
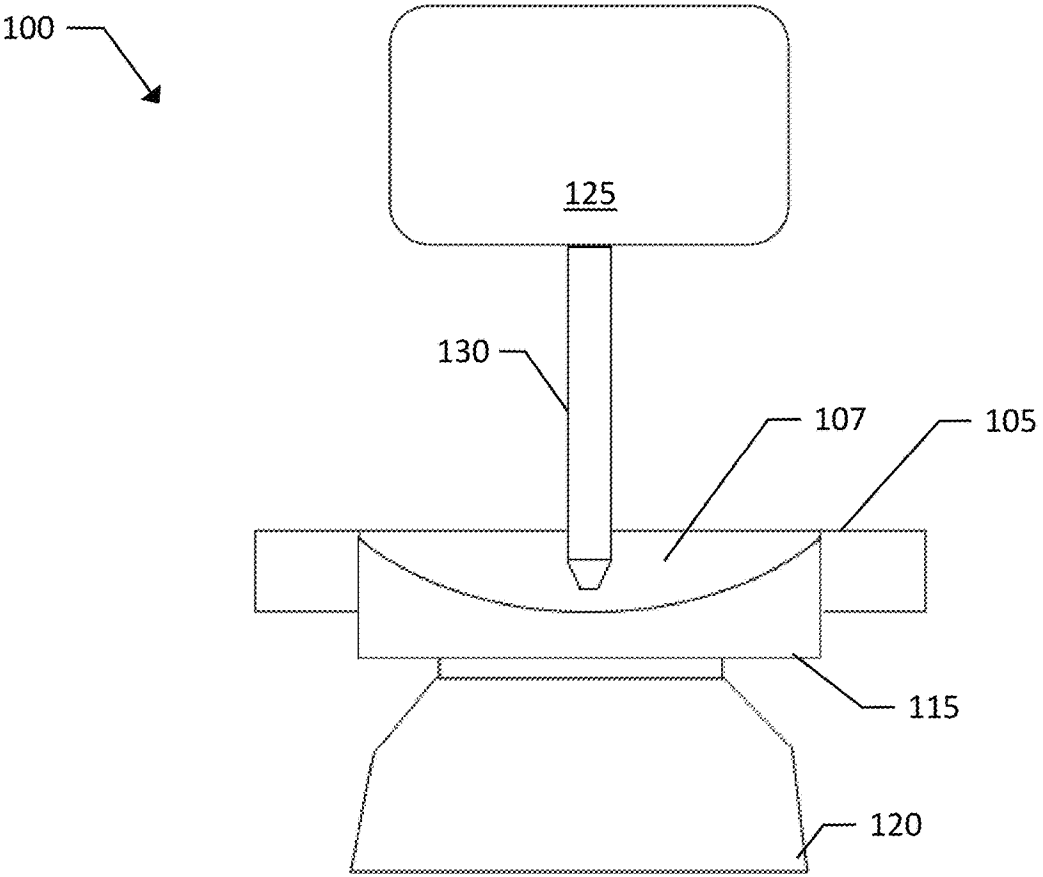
Figure 3:
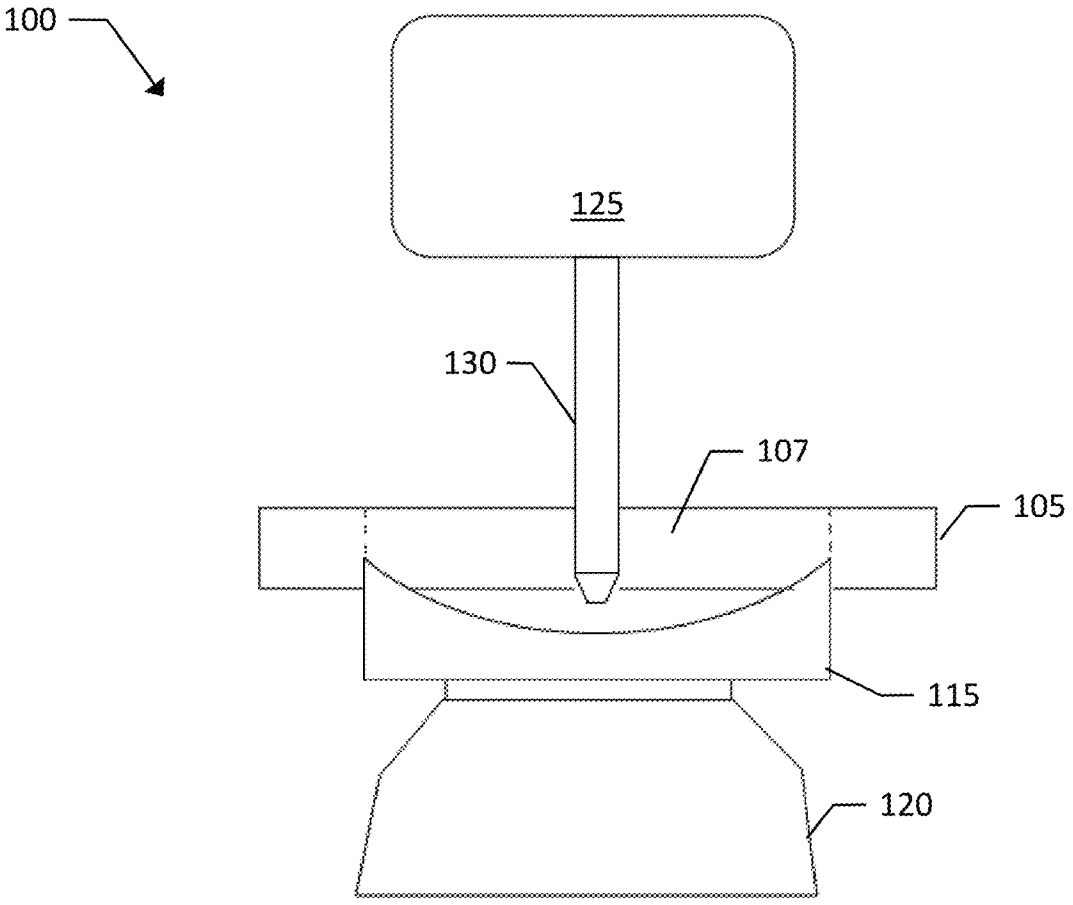
Figure 4:
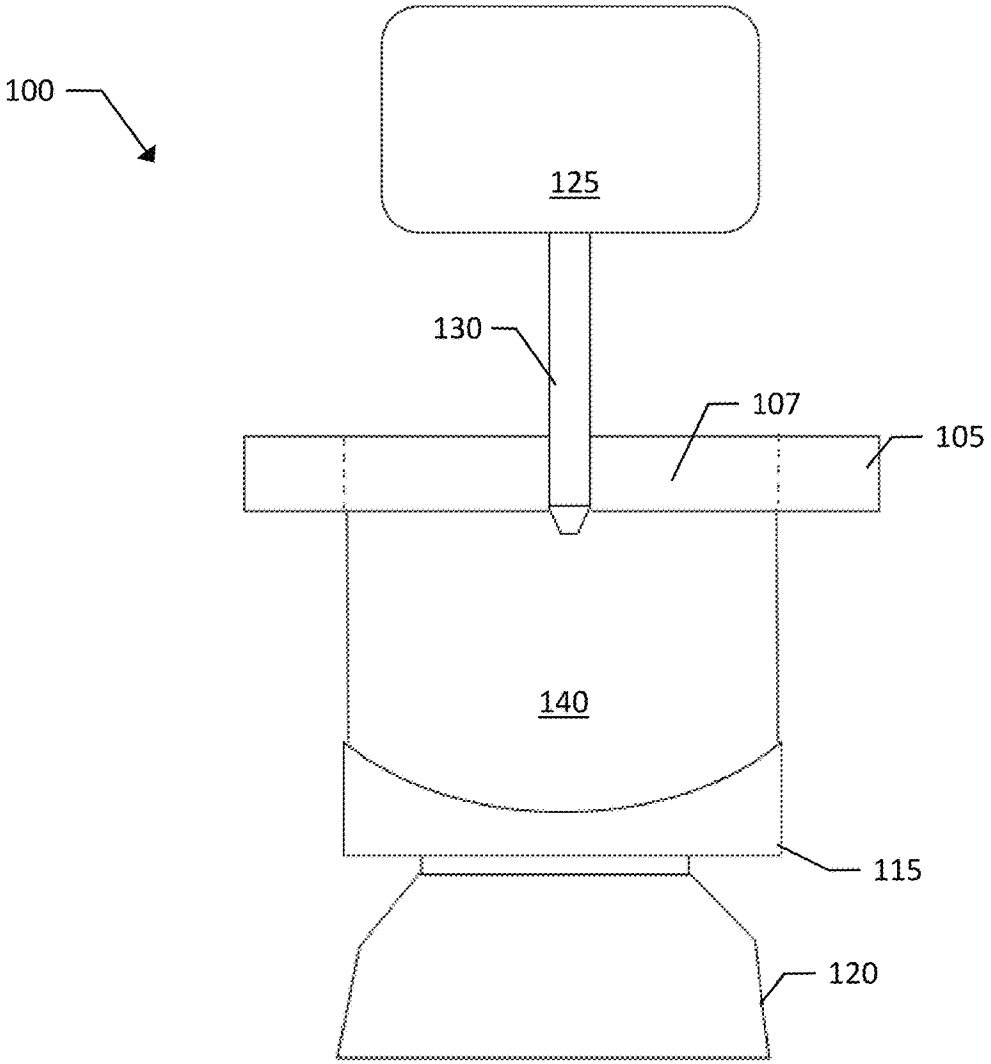
Figure 5:
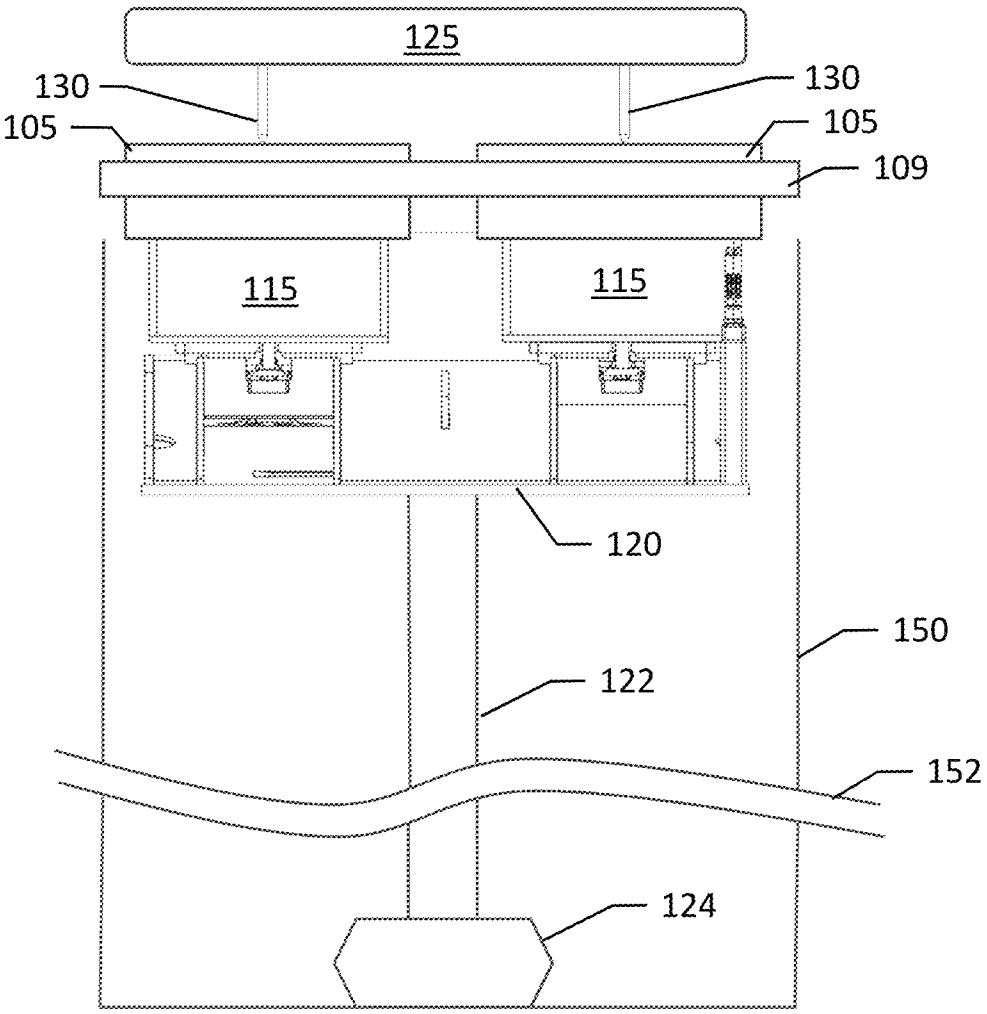
Figure 6:
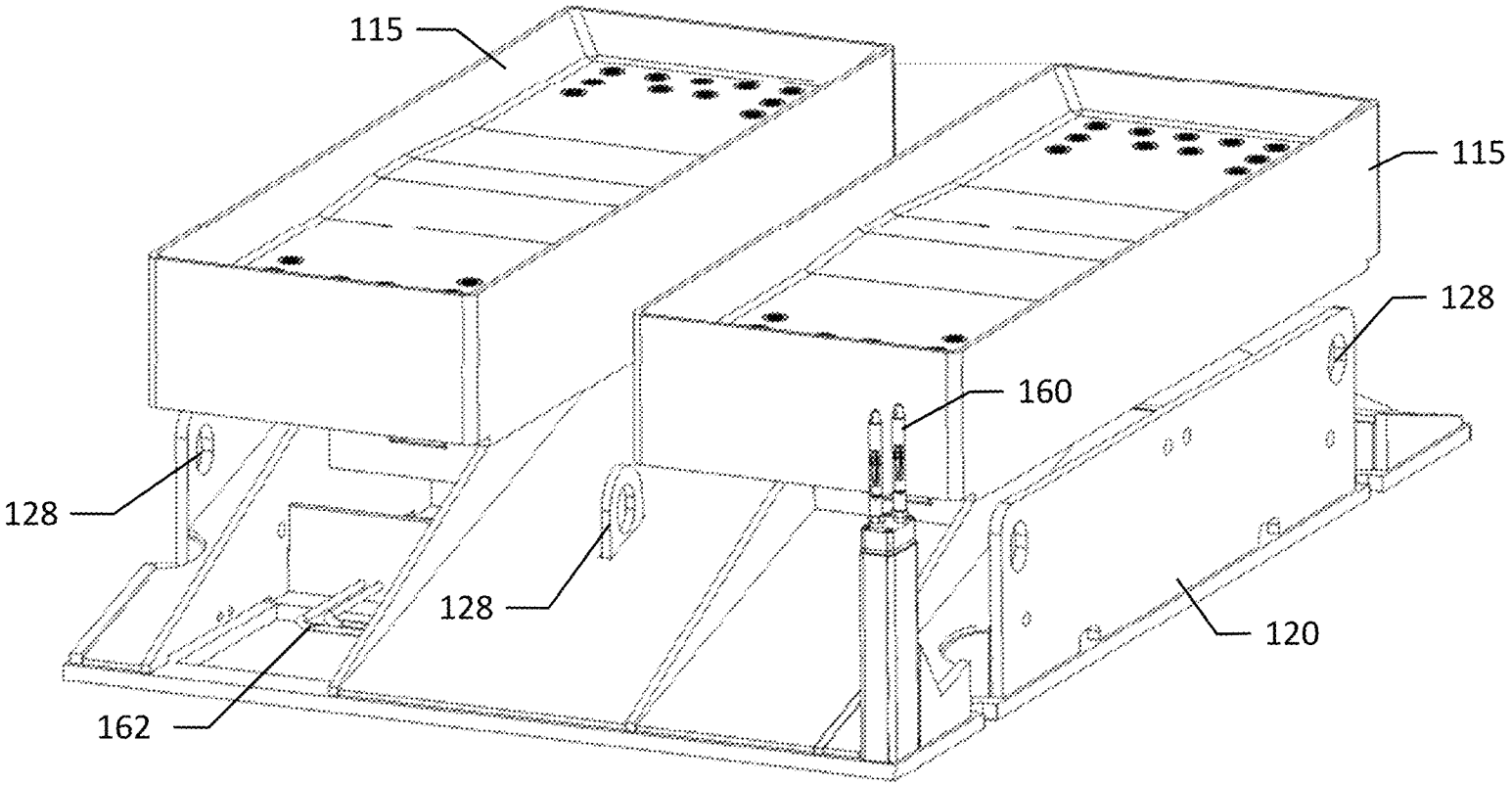
Figure 7:
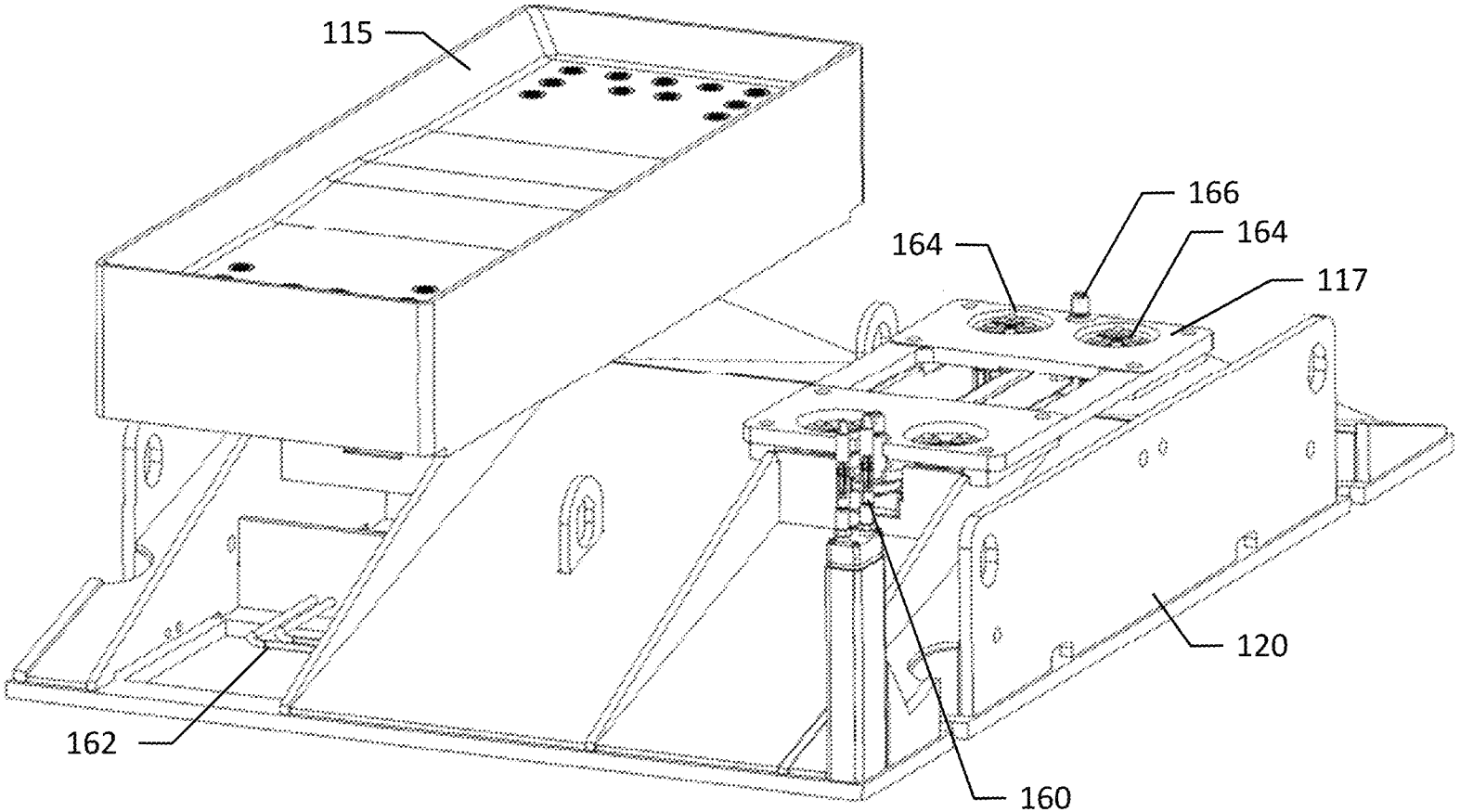
Figure 8:
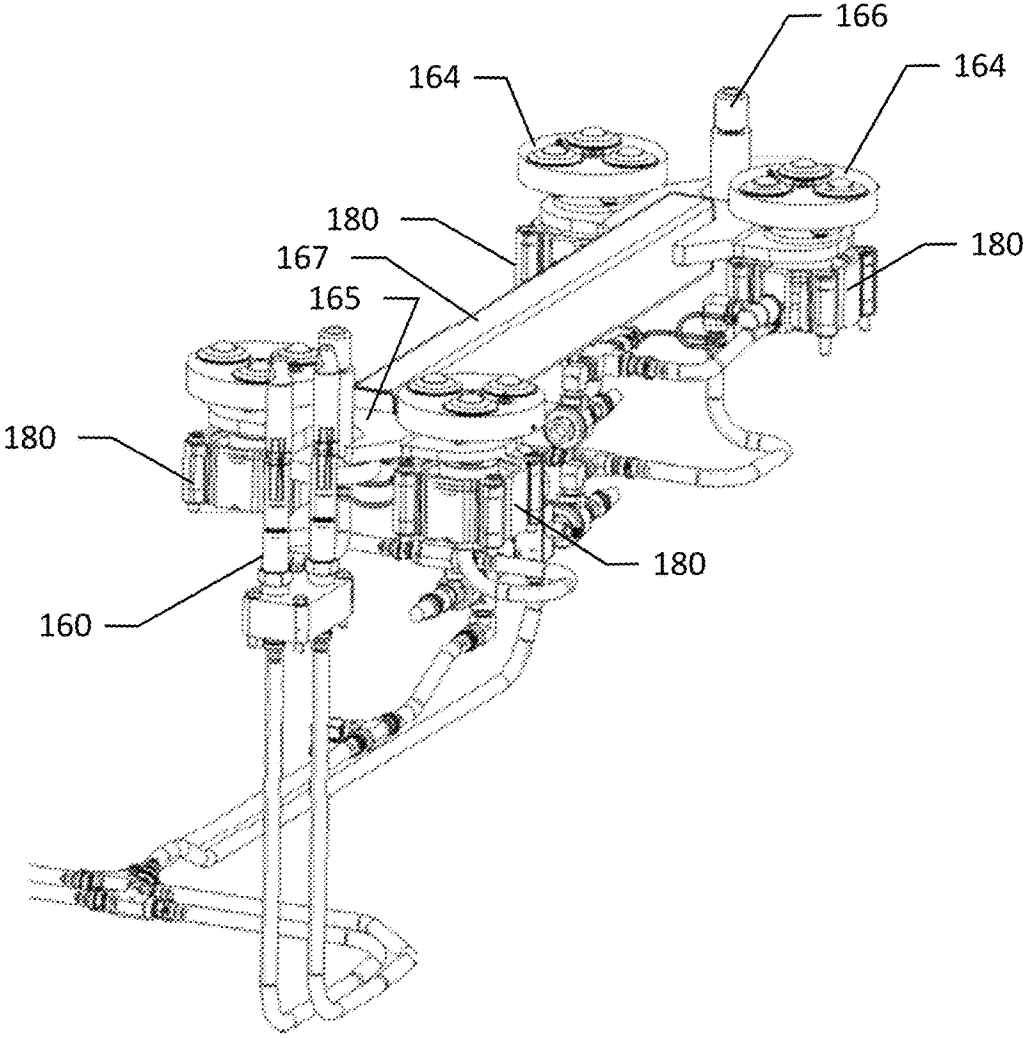
Figure 9:
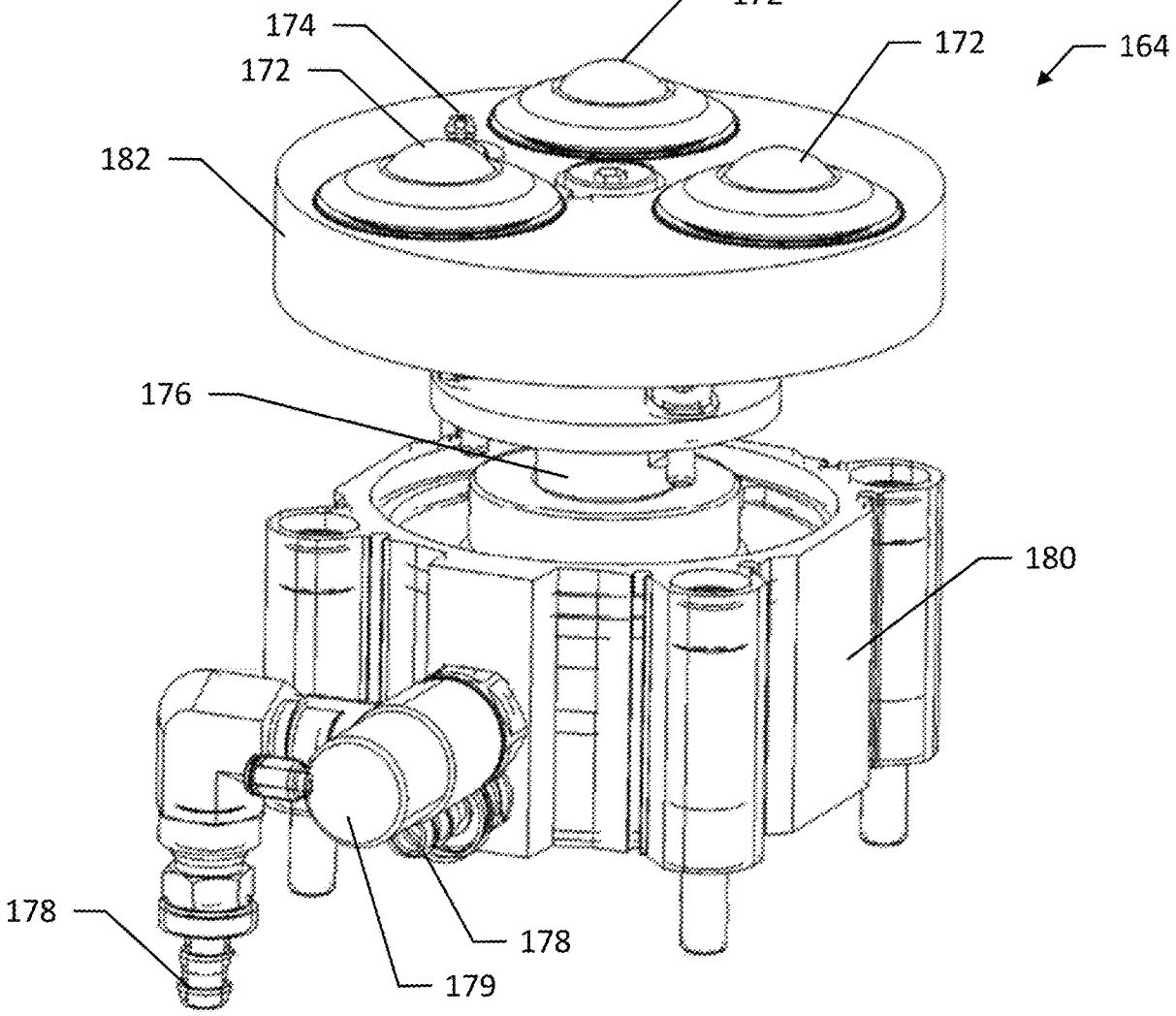
Figure 10:
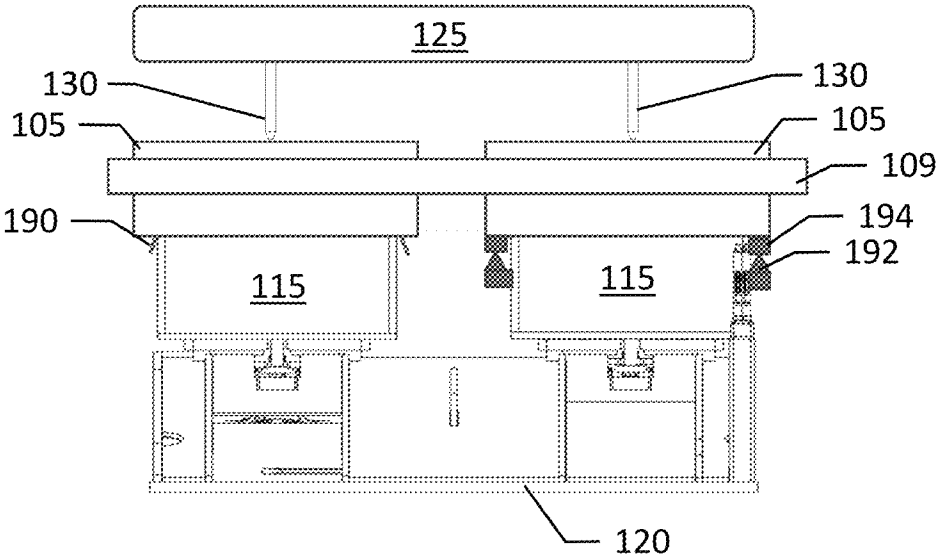
Figure 11:
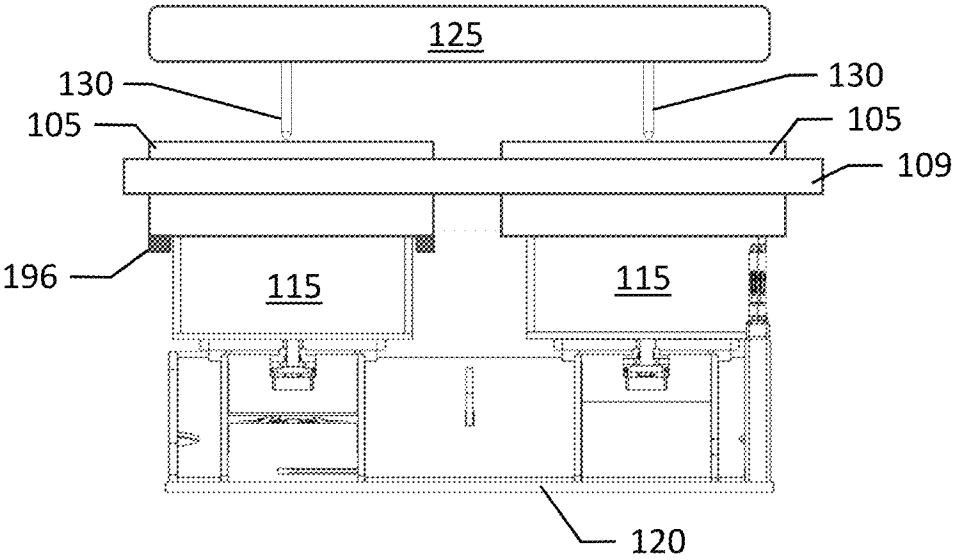
Figure 12:
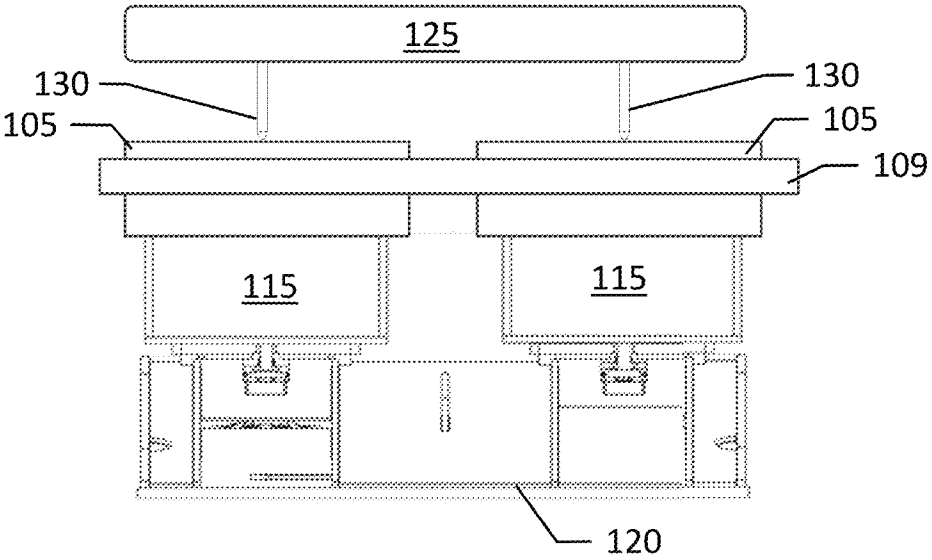
Figure 13:
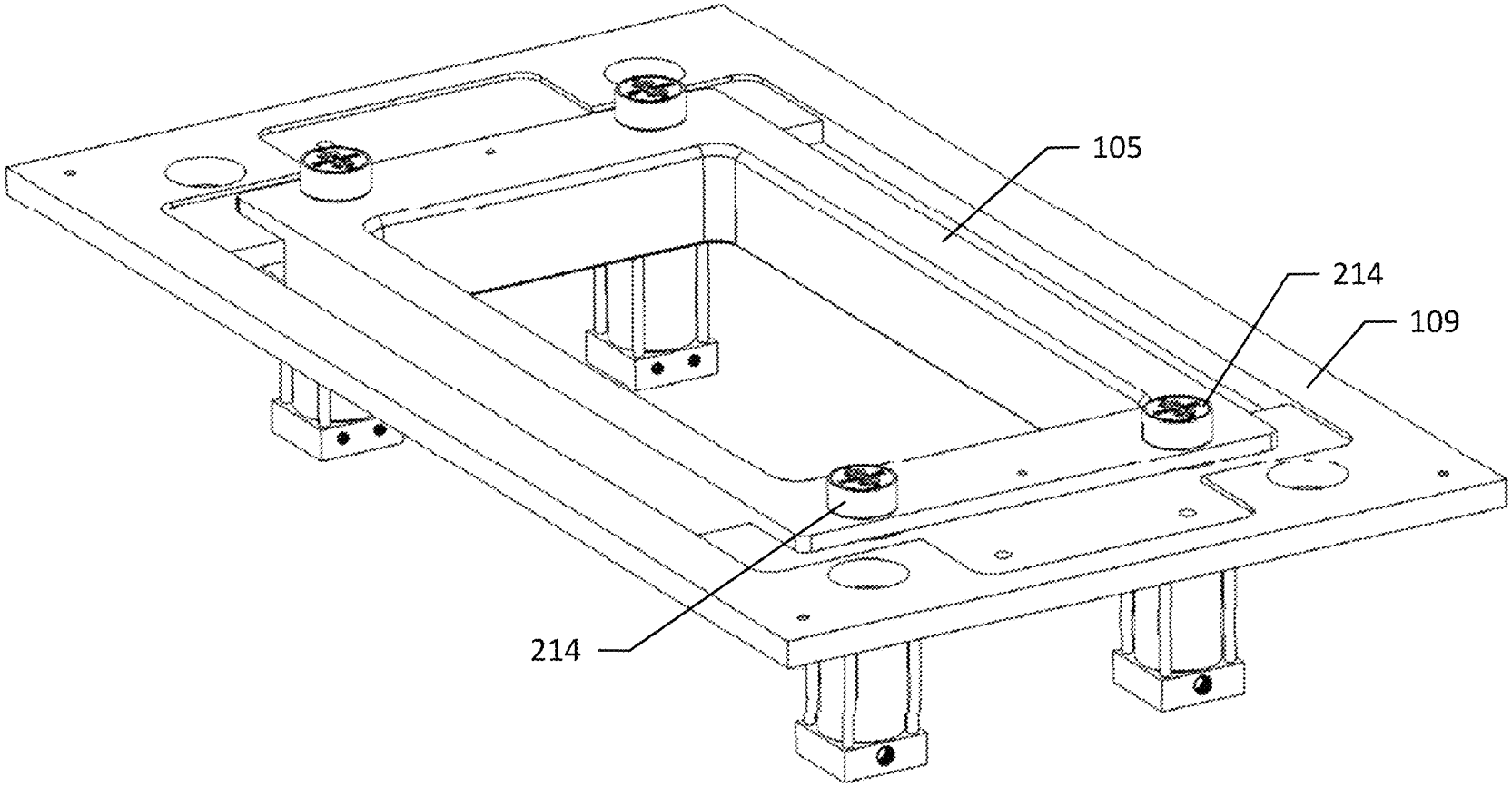
Figure 14:
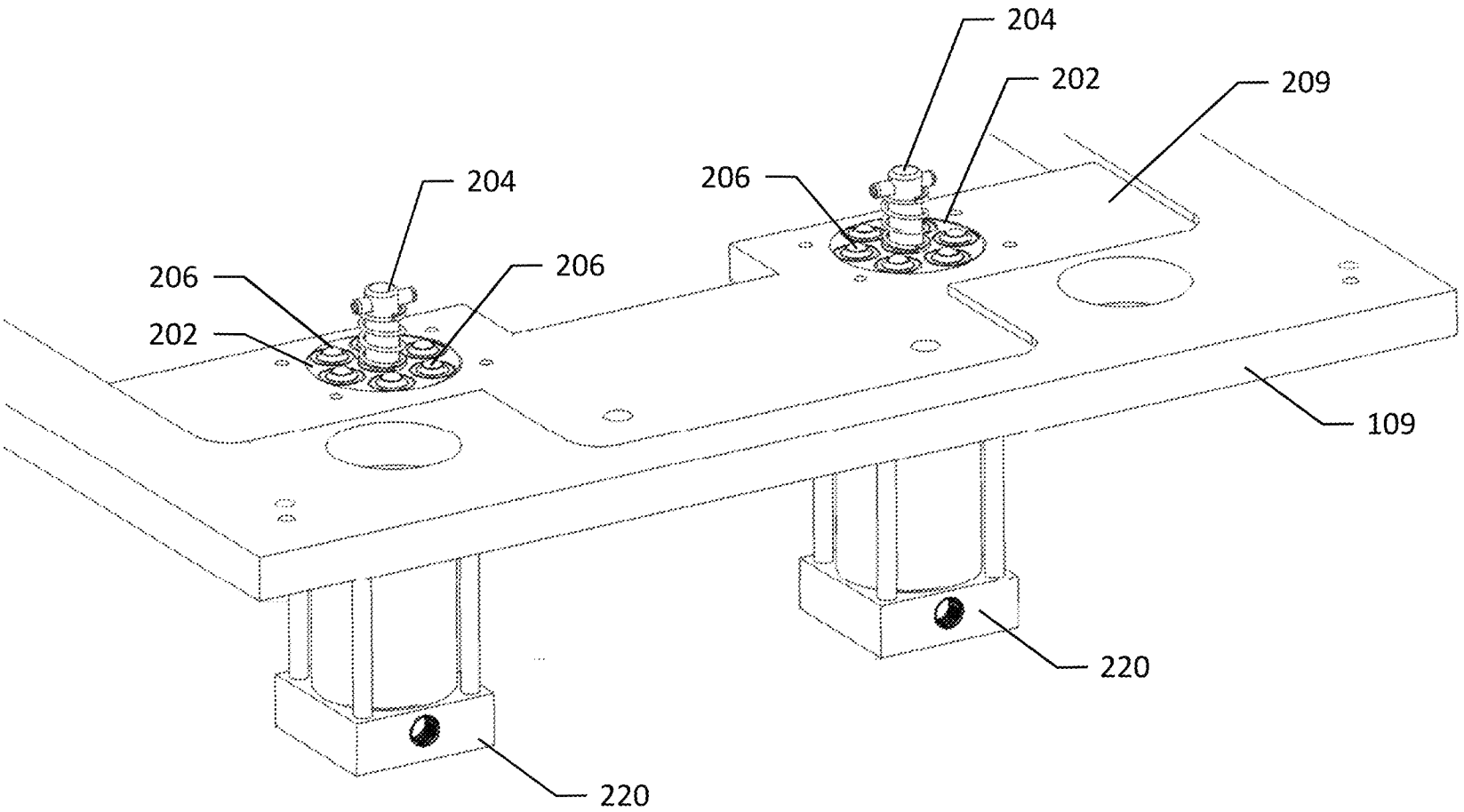
Figure 15:
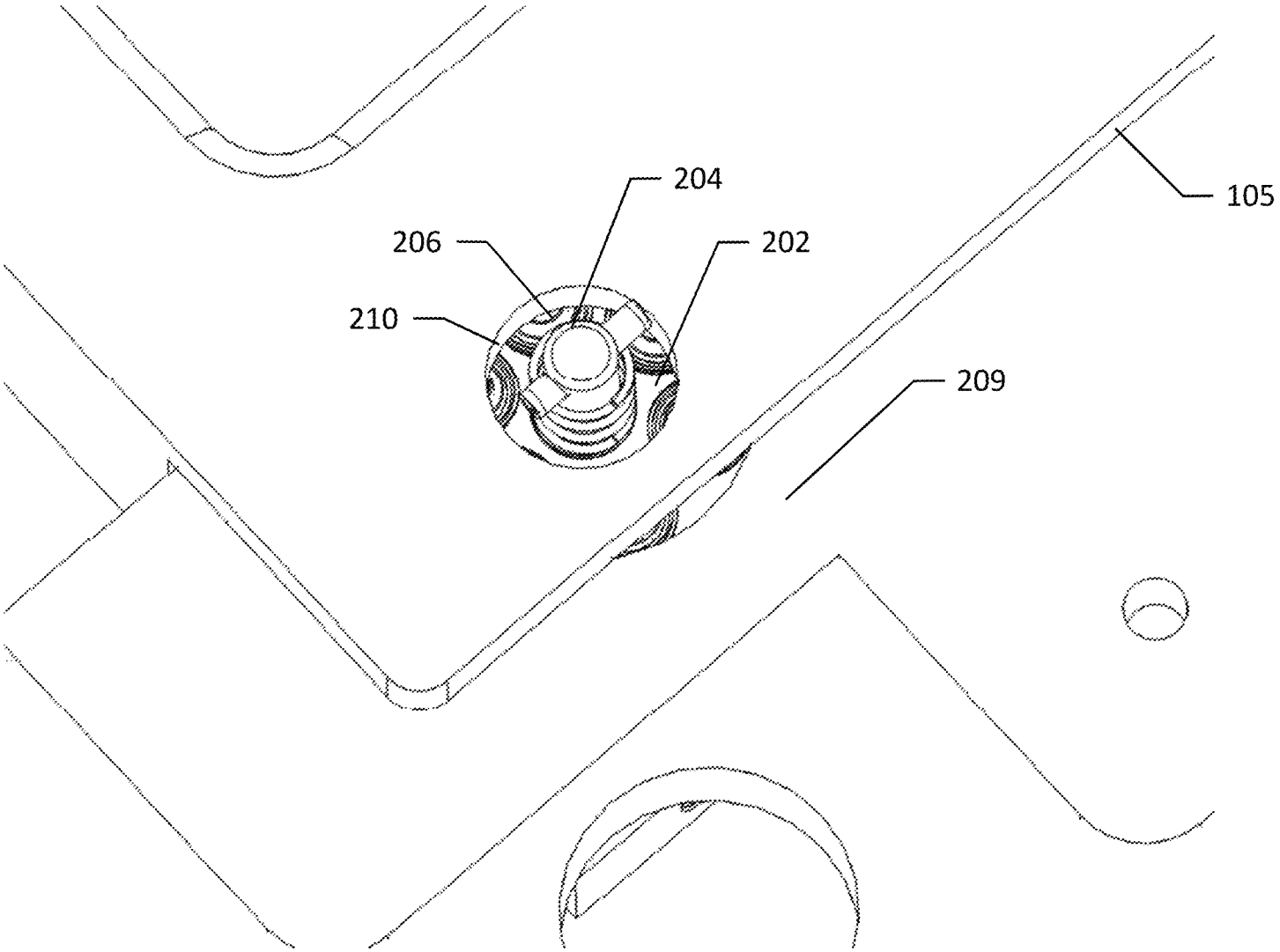
Figure 16:
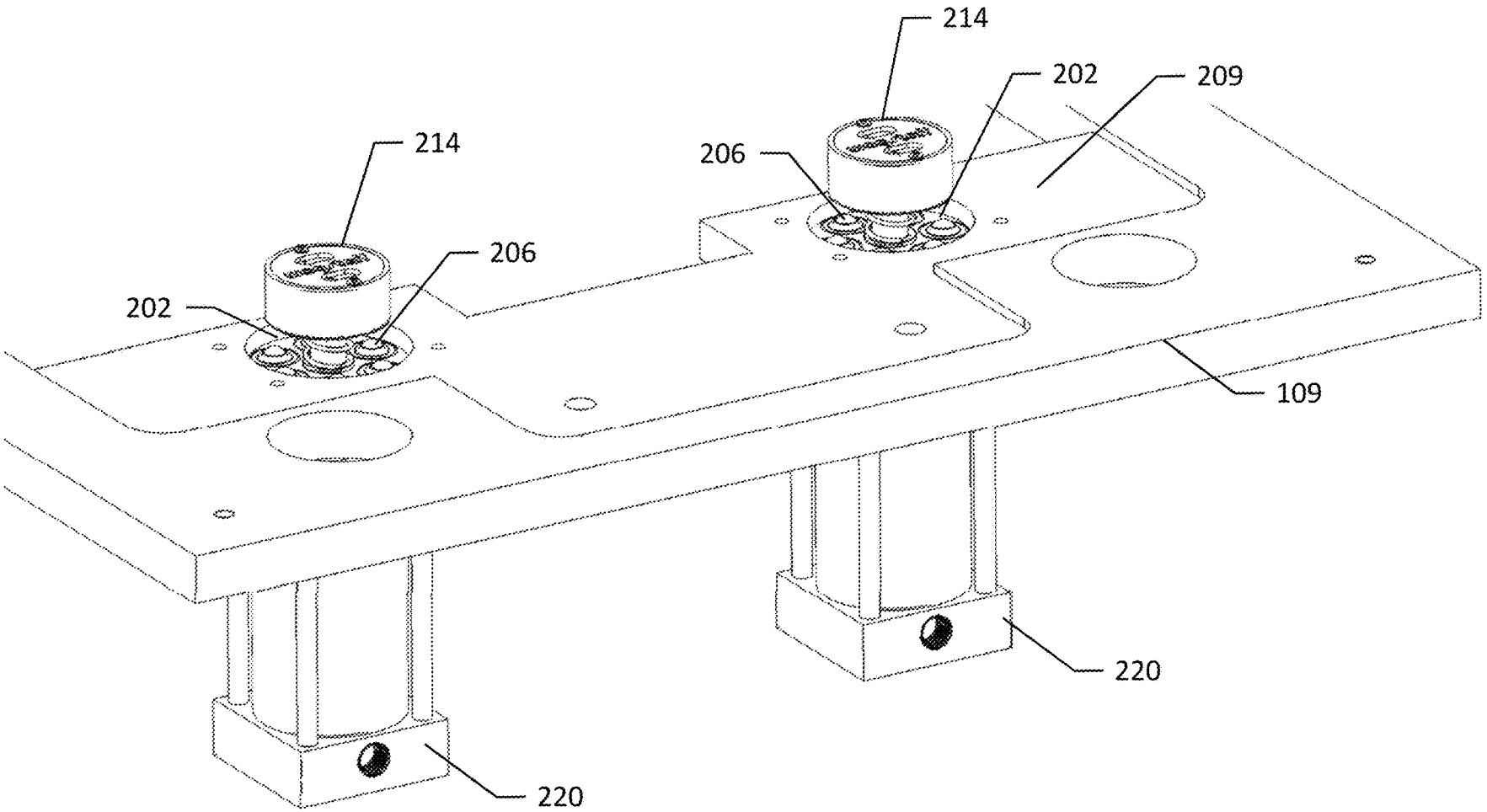

Having thus described the invention in general terms, reference will now be made to the accompanying drawings, which are not necessarily drawn to scale, and wherein:

FIG. 1 illustrates an example embodiment of a direct chill casting mold according to the prior art;

FIG. 2 illustrates an example of the initial stages of direct chill casting or continuous casting according to an example embodiment of the present disclosure;

FIG. 3 illustrates an example embodiment following the initial stages of direct chill casting according to an example embodiment of the present disclosure;

FIG. 4 illustrates an example embodiment of steady-state direct chill casting according to an example embodiment of the present disclosure;

FIG. 5 illustrates a system for aligning a starter block with a mold for direct chill casting according to an example embodiment of the present disclosure;

FIG. 6 illustrates a platform of a system for aligning a starter block with a mold for direct chill casting including two starter blocks according to an example embodiment of the present disclosure;

FIG. 7 illustrates the platform of FIG. 6 with one of the starter blocks omitted according to an example embodiment of the present disclosure;

FIG. 8 illustrates the bearing assemblies of a system for aligning a starter block with a mold for direct chill casting according to an example embodiment of the present disclosure;

FIG. 9 is a detail view of a bearing assembly of a system for aligning a starter block with a mold for direct chill casting according to an example embodiment of the present disclosure;

FIG. 10 illustrates alignment mechanisms for aligning a starter block with a mold for direct chill casting according to an example embodiment of the present disclosure;

FIG. 11 illustrates additional alignment mechanisms for aligning a starter block with a mold for direct chill casting according to an example embodiment of the present disclosure;

FIG. 12 illustrates an example embodiment of the present disclosure in which the continuous casting mold is moved relative to the starter block for alignment;

FIG. 13 depicts an example embodiment of a mold frame and continuous casting mold that is movable relative to the mold frame for alignment with the starter block according to an example embodiment of the present disclosure;

FIG. 14 illustrates a mold frame and bearing assemblies according to the example embodiment of FIG. 13;

FIG. 15 illustrates a detail view of the mold frame, bearing assembly, and continuous casting mold according to an example embodiment of the present disclosure; and FIG. 16 illustrates clamping members attached to bearing assemblies of an example embodiment of the present disclosure

DETAILED DESCRIPTION

Example embodiments of the present disclosure now will be described more fully hereinafter with reference to the accompanying drawings, in which some, but not all embodiments of the disclosure are shown. Indeed, embodiments may take many different forms and should not be construed as limited to the embodiments set forth herein; rather, these embodiments are provided so that this disclosure will satisfy applicable legal requirements. Like numbers refer to like elements throughout.

Embodiments of the present disclosure generally relate to a system, apparatus, and method to align a starter block of a direct chill mold system, also referred to as a continuous casting mold system, with a mold cavity of the system to substantially fill the mold cavity, and setting the optimum clearance between the starter block and the mold walls. Embodiments align the starter block with the mold thereby reducing molten metal leakage and reducing the likelihood of damage to one or both of the starter block or the mold walls.

Vertical direct chill casting or continuous casting is a process used to produce ingots or billets that may have a variety of cross-sections shapes and sizes for use in a variety of manufacturing applications. The process of direct chill casting begins with a horizontal mold table or mold frame containing one or more vertically-oriented molds disposed therein. Each of the molds defines a mold cavity, where the mold cavities are initially closed at the bottom with a starter block to seal the bottom of the mold cavity. Molten metal is introduced to each mold cavity through a metal distribution system to fill the mold cavities. As the molten metal proximate the bottom of the mold, adjacent to the starter block solidifies, the starter block is moved vertically downward along a linear path into a casting pit. The movement of the starter block may be caused by a hydraulically-lowered platform to which the starter block is attached. The movement of the starter block vertically downward draws the solidified metal from the mold cavity while additional molten metal is introduced into the mold cavities. Once started, this process moves at a relatively steady-state for a continuous casting process that forms a metal ingot having a profile defined by the mold cavity, and a height defined by the depth to which the platform and starter block are moved.

During the casting process, the mold itself is cooled to encourage solidification of the metal prior to the metal exiting the mold cavity as the starter block is advanced downwardly, and a cooling fluid is introduced to the surface of the metal proximate the exit of the mold cavity as the metal is cast to draw heat from the cast metal ingot and to solidify the molten metal within the now-solidified shell of the ingot. As the starter block is advanced downward, the cooling fluid may be sprayed directly on the ingot to cool the surface and to draw heat from within the core of the ingot.

FIG. 1 depicts a general illustration of a cross-section of a direct chill casting mold 100 during the continuous casting process. The illustrated mold could be for a round billet or a substantially rectangular ingot, for example. As shown, the continuous casting mold 105 forms a mold cavity from which the cast part 110 is formed. The casting process begins with the starter block 115 sealing or substantially filling the bottom of the mold cavity against mold walls of the continuous casting mold 105. As the platform 120 moves down along arrow 145 into a casting pit and the cast part begins to solidify at its edges within the mold walls of the continuous casting mold 105, the cast part 110 exits the mold cavity. Metal flows from pouring trough 125, which may be a heated reservoir or a reservoir fed from a furnace, for example, through spout 130 into the mold cavity. As shown, the spout 130 is partially submerged within a molten pool of metal 135 to avoid oxidation of metal that would occur if fed from above the molten metal pool 135. The solidified metal 140 constitutes the formed cast part, such as an ingot. Flow through the spout 130 may be controlled within the pouring trough 125, such as by a tapered plug fitting within an orifice connecting a cavity of the pouring trough 125 with a flow channel through the spout 130. Conventionally, the pouring trough 125, spout 130, and mold cavity/mold walls of the continuous casting mold 105 are held in a fixed relationship from the beginning of the casting operation through the end of the casting operation. Flow of metal through the spout 130 continues as the platform 120 continues to descend along arrow 145 into the casting pit. When the casting operation is to end, either by the platform being at the bottom of its travel, the metal supply running low, or the cast part reaching the completed size, the flow of metal through the spout 130 stops, and the spout assembled on the trough is removed from the molten pool of metal 135 to allow the molten pool to solidify and complete the cast part.

FIG. 2 illustrates an example embodiment of the direct chill casting process according to the present disclosure including a continuous casting mold 105, trough 125, and spout 130 for supplying molten metal from the trough to the cavity 107 of the mold. The illustrated embodiment of FIG. 2 includes a starting position where the tip of the spout 130 is positioned proximate the starter block 115 which is supported by the platform 120. The starter block 115 is positioned atop platform 120 and aligned to cooperate with the mold 105 to seal the mold cavity 107 and preclude molten metal from leaking from between the continuous casting mold 105 and the starter block 115.

FIG. 2 illustrates the start of a cast with the starter block 115 aligned with the mold continuous casting 105. As the cast starts shown in FIG. 3, the platform 120 descends with the starter block 115 as molten metal flows through the spout 130 from the trough 125, and solidifies on the starter block 115 and at the bottom of the mold cavity 107. In this manner, as the starter block 115 descends away from the continuous casting mold 105, the cast part, shown in FIG. 4 as 140, is formed. FIG. 4 illustrates the run-state phase of the casting process or the steady-state portion where the platform 120 descends at a near constant rate with the cast part 140 growing accordingly.

In order for the casting process to begin properly, the starter block 115 has to be aligned with the mold cavity 107 of the continuous casting mold 105. Any misalignment may result in molten metal escaping from the mold cavity before it has had the chance to solidify. Molten metal escaping from the mold cavity between the mold and the starter block before it has a chance to solidify will spill into the pit into which the platform 120 descends, which results not only in a lost cast part, but requires substantial cleaning of the pit and any affected components within the pit before casting may resume or start again. Further, continuous casting molds and starter blocks are precisely machined and somewhat susceptible to damage, such that if a starter block is brought into engagement with a mold and the two components are not properly aligned, one or both of the starter block and the mold may be damaged which can adversely affect the ability of the parts to generate a satisfactory casting.

Embodiments described herein provide a mechanism by which the starter block can be repeatably and accurately aligned with a continuous casting mold such that the mold cavity is sealed at a bottom of the mold cavity with the starter block. Embodiments include a system that is at least partially automated to reduce the manual, human interaction needed for alignment between the starter block and the mold. Example embodiments provided herein include embodiments in which the starter block is moved relative to the continuous casting mold for alignment, while other embodiments permit movement of the continuous casting mold relative to the starter block for alignment.

An example embodiment of a system to facilitate alignment between the starter block and the mold is illustrated in FIG. 5 in which a starter block 115 is shown supported by a platform 120 that includes features to both enable alignment through movement of the starter block relative to the mold and to lock or clamp the starter block to the platform once alignment is complete. As shown in the more detailed illustration of FIG. 5, more than one starter block 115 may be positioned on a single platform 120, with each starter block 115 associated with a corresponding continuous casting mold 105. Multiple continuous casting molds 105 may be supported by a mold frame 109 as shown. Each continuous casting mold 105 may be fed from a trough 125 through one or more respective spouts 130. FIG. 5 further illustrates the casting pit 150 into which the platform 120 may descend. The platform 120 is supported by a hydraulic ram 122 extending from hydraulic cylinder 124. The platform 120 is lowered into the casting pit 150, away from the continuous casting molds 105 as the hydraulic ram 122 is lowered into the hydraulic cylinder 124 which extends into the ground below the pit. The hydraulic ram 122 and cylinder 124 may be of varying lengths depending upon the depth of the casting pit 152, illustrated to have indefinite depth with break lines 152 based on the specific configuration of the casting pit and the desired maximum casting/billet length.

The continuous casting mold 105 and the starter block 115 may be aligned with one another when bringing the two components together. The alignment may be performed when lowering the mold frame 109 into position bringing the continuous casting mold 105 into alignment with the starter block 115. Optionally, the platform may be displaced to a lower position than when casting is started to position the starter block 115 below the continuous casting mold 105, and the platform 120 may be raised for alignment of the starter block with the mold. In either scenario, the continuous casting mold 105 and starter block 115 begin the alignment process displaced from one another to allow for alignment before or while the mold and starter block are brought into contact with one another.

FIG. 6 illustrates the platform 120 of FIG. 5 including the two starter blocks 115 with the molds, casting pit, and hydraulic ram omitted for ease of understanding. As shown, the platform 120 supports two starter blocks 115 atop a platform superstructure that provides stability and rigidity to support cast parts as they flow from their respective molds. As such, the platform may be made of a rigid material that is both strong enough to support elongate cast parts, but also resistant to the high temperatures and corrosive environment experienced in the casting pit. Materials such as aluminum, stainless steel, painted steel, or the like may be used for the platform 120. The platform may include coupling features such as eyelets 128 which may be used in combination with a hoist or crane to interchange different platforms within the casting pit to accommodate different mold and starter block configurations.

Also shown in FIG. 6 are fittings 160 which may include pneumatic fittings integrated into the platform 120. The fittings 160 may be stab-fittings or press-fit fittings that are capable of engaging and disengaging mating fittings through pressing engagement and may not require manual assistance for engagement or disengagement. The fittings 160 are plumbed into the platform, as shown at 162, for conveying high-pressure air and/or vacuum to embodiments of the alignment system described herein. The fittings 160 may be configured to engage a pressure source and/or vacuum source when the platform is at the top of the travel of the hydraulic ram and the starter blocks 115 are aligned with their respective continuous casting molds 105. As will be appreciated through the description below, alignment of the starter blocks 115 with their respective continuous casting molds 105 occurs at the top of the travel of the hydraulic ram. When the starter blocks 115 and the platform 120 descend into the casting pit, the fittings 160 may disengage from their pressure/vacuum source as the pneumatic functionality of the alignment system of the platform 120 is no longer needed.

FIG. 7 illustrates the platform 120 of FIG. 6 with one of the two starter blocks 115 removed to illustrate an embodiment of the alignment system disclosed herein. As noted above, alignment between the starter block 115 and a corresponding continuous casting mold 105 is critical to ensure molten metal does not leak from between the starter block and the mold, but also to reduce the likelihood of damage to either the starter block or the mold. Poor alignment between the starter block 115 and the continuous casting mold 105 may result in a defective casting or a failed casting session where a casting cannot be formed. Manual alignment of starter blocks with molds is challenging and cumbersome such that the methods described herein provide advantages of substantially automated or at least partially automated alignment between the starter block and mold. Further, manual alignment may be employed with embodiments described herein which facilitate alignment through a mechanism to allow the starter blocks to be easily moved either through automated or manual means.

The starter block 115 may be aligned with a respective continuous casting mold 105 when the mold frame 109 shown in FIG. 5 is lowered and the continuous casting molds 105 engage the starter blocks. Optionally, the starter blocks 115 may be positioned below the mold 105 as the mold frame 109 is moved into position above the casting pit 150, and the hydraulic ram 122 may raise the platform 120 from a position in which the starter blocks 115 are not engaged with the continuous casting molds 105 to a position in which the starter blocks 115 are engaged with the continuous casting molds 105. In either circumstance, movement of the starter block 115 and continuous casting mold 105 relative to one another provides the ability to align the starter block with a corresponding mold. Embodiments described herein provide a system for alignment of the starter block 115 with the continuous casting mold 105 by enabling the starter block to move easily atop the platform 120 during the alignment operation.

Referring back to FIG. 7, the platform 120 of an example embodiment includes bearing assemblies 164 disposed below a starter block support plates 117. In a retracted position, the bearing assemblies 164 are flush or below a support surface of the starter block support plates 117 as shown in the figure. With the starter block 115 resting on the starter block support plates 117, the starter block 115 is relatively stable and the position relatively fixed. However, to further secure the starter block 115 to the starter block support plates 117 of the platform 120, locking pins 166 are attached to the starter block and extend below the starter block support plates 117. The locking pins 166 function as a clamping mechanism through engagement with locking clamp member 167 (shown in FIG. 8) and clamping plate 165. Upon cylinder 180 retraction, the clamping plate 165 engages with a flange of locking pin 166 to drive the starter block 115 against the starter block support plates 117, which increases a force between the starter block 115 and the starter block support plate 117 to be greater than the weight of the starter block alone atop the starter block support plates. This added force of the clamping plate 165 engaging with locking pin 166 serves to lock the starter block 115 to platform 117 The locking pins 166 of the illustrated embodiment may be threaded into the starter block 115 to secure the starter block to the clamping mechanism. However, example embodiments may include an intermediate plate disposed between the locking pins 166 and the starter block 115. The intermediate plate may be coupled to the locking pins, while the intermediate plate may offer a quick-release mechanism for securing the starter block 115 to the intermediate plate. Such a configuration would enable changing of the starter blocks without requiring the locking pins 166 to be removed from below the starter block support surfaces, which may be cumbersome in some environments. The quick release mechanism of such an intermediate plate may also function to align the starter block with the intermediate plate to hold the starter block fixed relative to the intermediate plate. In this manner, alignment may be performed as described herein with the only difference including an intermediate plate disposed between the starter block 115 and the platform 120.

During alignment, the bearing assemblies 164 may be raised relative to the starter block support plates 117 such that bearing surfaces of the bearing assemblies stand proud of the starter block support plates. FIG. 8 illustrates the bearing assemblies 164 in a system pneumatically coupled to the couplings 160. FIG. 9 details a bearing assembly having three roller ball transfer bearings 172 supported on bearing plate 182 that are able to facilitate movement in both axes of a plane defined by the three bearings 172. This plane is the plane along which the starter block 115 moves during alignment with the continuous casting mold 105. The bearing assemblies may be coupled to the pneumatic cylinder assemblies with a spherical bearing to enable the bearing assemblies to pivot to some degree in order to properly engage the starter block 115. Starter blocks may warp over time such that some degree of freedom of the bearing assemblies is desirable. Further, the starter blocks may be made of various alloys of aluminum or steel; however, as aluminum tends to be soft, and steel tends to rust, starter blocks 115 of example embodiments may include bearing engagement plates on a bottom side of the starter block with which the bearing assemblies engage. The bearing engagement plates may be made of stainless steel to overcome the deficiencies of an aluminum or steel starter block.

While some embodiments of the bearing assembly may not require lubrication, the illustrated embodiment includes a grease zerk fitting 174 to receive lubricant for the bearing assembly. The illustrated bearing assembly 164 further includes a pneumatic cylinder 176 and pneumatic cylinder assembly 180 whereby the bearing plate 182 can be raised and lowered relative to the pneumatic cylinder body 180 by virtue of pressure and/or vacuum applied to the pneumatic connectors 178.

This pneumatic cylinder enables the bearings 172 to be raised into contact with the starter block 115 and to support the weight of the starter block 115 on the bearings 172. The pneumatic cylinder operates in cooperation with the other pneumatic cylinder assemblies shown in FIG. 8 such that the weight of the starter block 115 is borne by multiple pneumatic cylinders and bearing assemblies 164. The pneumatic cylinder assemblies need only be able to support the weight of the starter block 115 during alignment as once the starter block is aligned, the bearing assemblies 164 may be lowered such that the starter block is again supported by support plates 117 illustrated in FIG. 7. The pneumatic cylinders 180 may be equipped with quick-exhaust valves 179 that may release pressure from the pneumatic cylinders 180 quickly. This quick-release may lower the bearing assemblies 164 rapidly to place the starter block 115 in the high-friction state more quickly such that alignment between the starter block 115 and the continuous casting mold 105 is not lost during a slow lowering process.

Embodiments described herein provide a system for alignment of a starter block with a mold where the system operates between three states. A first state includes raised bearing assemblies 164 as shown in FIG. 8, where the starter block 115 is supported by bearings 172 and is able to translate within the plane defined by the bearing assemblies 164 with relative ease. This enables the starter block 115 to be moved into alignment with the continuous casting mold 105. Once alignment between the starter block and the mold is achieved, through automated, semi-automated, or manual movement of the starter block, the system lowers the bearing assemblies 164 using the pneumatic cylinder assemblies 180 such that the starter block is no longer supported by bearings 172, but is instead supported by starter block support plates 117. Once the starter block is resting on the starter block support plates, the starter block may be locked down into the aligned position using clamping system described above including the locking pins 166, clamp member 167, and clamping plate 165.

While example embodiments described and illustrated herein disclose a pneumatic cylinder used as a lifting mechanism to raise the bearing assemblies into contact with the starter block, other lifting mechanisms may be employed to move the bearing assemblies between a raised position in which the bearing surface is proud of the starter block support surface and a lowered position in which the bearing surface is recessed below the starter block support surface. For example, the bearing assemblies 164 may be moved from the lowered position to the raised position using a cam mechanism whereby rotation of the cam lifts the bearing assemblies. Other mechanisms may include hydraulic cylinders, electric servo motors, electric solenoids, or the like. As such, the lifting of the bearing assemblies may be accomplished by a variety of different lifting mechanisms.

While embodiments of the figures illustrate bearing assemblies 164 used to enable the starter block to be moved for alignment, embodiments may use other mechanisms by which the starter block can be relatively easily moved relative to the platform and the mold to bring the starter block into alignment with the mold. Some mechanisms to achieve this may include compressed air bearings to create a layer of air on which the starter block floats to some degree, low friction coatings or liners on which the starter block may translate, lubricants such as greases or oils, flowing water bearing floatation, compressed air and oil mixture, compressed air and water mixture, or electro magnets to repel the starter block from the platform to "float" the starter block, for example.

While the starter block is in a low-friction state relative to the platform, using the bearing assemblies 164 of the figures or any of the aforementioned techniques, alignment of the starter block to the mold may be accomplished in a variety of ways. An alignment jig including spacers or shims placed on either the mold or the starter block may guide the starter block into alignment with the mold as they are brought together—either through the lowering of a mold frame or the raising of the platform to meet the mold. Optionally, pins or guides with alignment lugs that engage and force the starter block into alignment with the mold as they are brought together may be used. According to some embodiments, physical parts that move into or out of position, such as cylinders (pneumatic or hydraulic) or mechanical equipment may move into place the starter block with the mold. Analog sensors may be used to measure distances needed for alignment and actuators may be used in combination with these sensors to sense alignment and move the starter block accordingly.

FIG. 10 illustrates two example embodiments of alignment features or alignment guides that may be employed to align the starter block 115 with a respective continuous casting mold 105. As shown, the mold may include alignment tabs 190 as an alignment guide configured to guide the starter block 115 into alignment with the continuous casting mold 105 as the starter block is brought into contact with the mold. Also shown is a pin 192 and receiver 194 alignment guide by which a tapered pin may be used to align the starter block 115 with the continuous casting mold 105 as the two are brought into contact with one another. FIG. 11 illustrates another example embodiment of an alignment feature or alignment guide that includes a proximity sensor 196 which may act in cooperation with one or more actuators to move the starter block 115 into alignment with the continuous casting mold 105 based on a signal from the proximity sensor 196. The actuator may be incorporated into the same element as the proximity sensor 196 or may be located remotely therefrom. Beyond a proximity sensor, an image sensor may be used to detect an alignment offset between the mold and the starter block. The image sensor may capture an image of one or both of the starter block and the mold and to identify an alignment offset along which the starter block needs to move to be in alignment with the mold. Manual alignment of the continuous casting mold 105 with the starter block 115 may also be performed as the alignment system enables the starter block to be moved along both axes of a plane for alignment using a force substantially lower than a force that would be required to move the starter block when supported by the starter block support surfaces. The forces required to move the starter block 115 when supported by the bearing assemblies may be very low and may be performed with relative ease. Conversely, when the starter block is supported by the starter block support surfaces, movement may be very difficult and the forces required to perform such movement may be greater than can generally be applied manually by a user. A force below a predefined threshold may be used to move the starter block 115 when supported by the bearing assemblies in both of two orthogonal directions relative to the platform 120, while a force below the predefined threshold will not move the starter block relative to the platform when the bearing assemblies are in the lowered, retracted position.

Once alignment is complete, the starter block may be lowered onto the starter block support plates which may include a high or relatively-high friction surface such that the starter block no longer moves relative to the platform. The high friction surface may include a metal surface which may be textured or a surface with an added texture such as a high-friction liner or coating that includes a high friction finish.

One or more clamps can be actuated to clamp the starter block in place once alignment is complete. Clamping of the starter block in place further precludes movement of the starter block which may damage the mold or the casting part or process. Each starter block supported by a platform may have an individual system for alignment, or in some embodiments where the molds are at fixed positions relative to one another, starter blocks may be joined with the same fixed positions relative to one another requiring alignment of the plurality of starter blocks at the same time.

As described above with respect to FIG. 7, the platform 120 may include couplings 160 to connect to a source of energy for the alignment system. While the above-described embodiments include a pneumatic energy source, whereby pressurized air and/or vacuum may be applied to the alignment system via the couplings 160, embodiments may include a hydraulic source where hydraulic pressure is conveyed to the alignment system through couplings 160. Optionally, the alignment system may be electro-mechanical, whereby the couplings may include power couplings to receive electricity to power the alignment system. As the alignment system is only necessary before the casting process begins, the alignment system need only be supplied with energy when it is at the top of the casting pit 150 as shown in FIG. 5. As such, the couplings 160 may engage mating couplings that are positioned proximate the mold frame 109, and in some cases, may be attached to the mold frame. For example, the couplings may be pneumatic stab fittings where at the top of the travel of the platform, the couplings 160 engage corresponding stab fittings to supply air to the alignment system. As the platform 120 descends into the casting pit 150, the stab fitting couplings 160 may be pulled from their corresponding couplings thereby releasing the pneumatic source from the alignment system.

The example embodiments described above involve movement of the starter block 115 relative to the continuous casting mold 105 for alignment. However, embodiments may include a continuous casting mold 105 that is movable relative to a stationary starter block 115 for alignment. FIG. 12 illustrates such an example embodiment in which a continuous casting mold frame 109 supports the continuous casting molds 105, whereby the continuous casting molds may be aligned with the starter blocks.

FIG. 13 illustrates another example embodiment in which the continuous casting mold 105 is movable relative to a stationary starter block 115 for alignment. The continuous casting mold 105 of FIG. 13 is shown without a starter block for ease of illustration, and while FIG. 12 illustrates two continuous casting molds 105 in a mold frame 109, FIG. 13 includes only one continuous casting mold 105. Embodiments may include more continuous casting molds in the frame based on the capacity of a casting pit or on the needs of a user. However, one of ordinary skill in the art will appreciate that the alignment system of FIGS. 13-16 can be implemented for any number of molds. As shown, the continuous casting mold 105 sits within the mold frame 109, clamped in place using clamp members 214 that are actuated by cylinders 220, which may be pneumatic, hydraulic, or electro-mechanical.

FIG. 14 illustrates a portion of the mold frame 109 with the continuous casting mold 105 removed. The mold frame 109 of the illustrated embodiment includes bearing assemblies 202 which are movable between a raised position and a lowered position. In the raised position shown in FIG. 14, the continuous casting mold 105 may be supported by the bearing assemblies 202. In the raised position, the bearing assemblies 202 are positioned such that the bearings 206 stand proud of a top surface 209 of the mold frame 109, and the continuous casting mold 105 is supported on the bearings 206. A continuous casting mold supported by the mold frame 109 is lifted from the top surface 209 of the mold frame in response to the bearing assemblies 202 being moved to the raised position such that the continuous casting mold is supported by bearings 206.

The bearing assemblies 202 of the illustrated embodiment include a shaft 204 that extends from the bearing assembly and travels with the bearing assembly between the raised position and the lowered position. The shaft 204 extends through a hole of the continuous casting mold 105, such that the bearings 206, in the raised position, engage the continuous casting mold around this hole. FIG. 15 illustrates an overhead view of a corner of the continuous casting mold 105 with the shaft 204 of the bearing assembly 202 protruding through hole 210 of the continuous casting mold 105. As shown, the hole 210 is smaller in diameter than the bearing area of the bearings 206 such that the continuous casting mold will be supported by the bearings with the shaft 204 having room within the hole 210 to allow for alignment.

The shaft 204 receives thereon a clamp member 214 as shown in FIG. 16 with the continuous casting mold 105 removed. The clamp member 214 is removable in order to remove the continuous casting mold 105 from the mold frame 109. Generally, the clamp member 214 will be assembled to the shaft 204 when the continuous casting mold 205 is in position on the top surface 209 of the mold frame 109. With the clamp member 214 in place and the bearing assemblies in the raised position, the continuous casting mold 105 is movable relative to the mold frame 109 in two orthogonal directions in a plane defined by the bearing assemblies. When the continuous casting mold 105 is supported by the bearings 206 of the bearing assemblies 202, the continuous casting mold can be easily moved in the orthogonal directions with forces below a predetermined threshold. This enables alignment of the continuous casting mold 105 with the corresponding starter block 115.

Once the alignment of the continuous casting mold 105 with the starter block 115 is complete, the bearing assemblies 202 may be moved to a lowered, retracted position where they are lowered into the mold frame 109 and the bearings 206 disengage from the continuous casting mold 105. This may be accomplished using cylinders 220 as described above with respect to the aforementioned embodiment. Also as noted above, the pneumatic cylinders may include quick exhaust valves that allow the bearing assemblies 202 to be lowered at a relatively rapid pace such that alignment is not lost during retraction. Once the bearing assemblies 202 are lowered, the continuous casting mold 105 rests on the mold frame 109 with a relatively high degree of friction between the mold frame and the continuous casting mold. In this position, forces below the threshold force that would be sufficient to move the continuous casting mold while supported by the bearings are not sufficient to move the continuous casting mold relative to the mold frame.

As the bearing assemblies are lowered, the clamp member 214, which is larger than the hole 210 of the continuous casting mold, clamps the continuous casting mold between the clamp member 214 and the mold frame 109. This clamping force drives the continuous casting mold 105 into engagement with the mold frame with a force greater than the weight of the continuous casting mold alone, thereby further securing the aligned position of the continuous casting mold.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A continuous casting mold alignment system comprising:

a continuous casting mold;

a mold frame supporting the continuous casting mold;

a starter block; and at least one bearing assembly, wherein the at least one bearing assembly is movable by a lifting mechanism between a lowered position and a raised position, wherein the at least one bearing assembly, in the raised position, engages and supports one of the continuous casting mold or the starter block, wherein the at least one bearing assembly, in the raised position, enables the one of the continuous casting mold or the starter block to be moved into alignment with the other of the continuous casting mold or the starter block by a force below a predefined threshold, wherein in the lowered position, the at least one bearing assembly disengages the one of the continuous casting mold or the starter block, wherein in response to the at least one bearing assembly being in the lowered position, the one of the continuous casting mold or the starter block cannot be moved by a force below the predefined threshold.

2. The continuous casting mold alignment system of claim 1, further comprising at least one pneumatic cylinder, wherein the at least one bearing assembly is moved between the raised position and the lowered position by the at least one pneumatic cylinder.

3. The continuous casting mold alignment system of claim 1, further comprising an alignment guide arranged between the starter block and the continuous casting mold, wherein the alignment guide causes movement of the one of the starter block or the continuous casting mold relative to the other of the starter block or the continuous casting mold in response to the one of the starter block or the continuous casting mold being supported by the at least one bearing assembly and the starter block engaging the continuous casting mold.

4. The continuous casting mold alignment system of claim 3, wherein the alignment guide comprises a tapered pin and a receiver, wherein the movement of the starter block is performed as the tapered pin engages the receiver.

5. The continuous casting mold alignment system of claim 1, wherein the at least one of the continuous casting mold or the starter block comprises the starter block, wherein the system further comprising a platform defining a support surface, wherein in response to the at least one bearing assembly being in the lowered position, the starter block is supported by the support surface, and wherein in response to the at least one bearing assembly being in the raised position, the starter block is supported by the at least one bearing assembly.

6. The continuous casting mold alignment system of claim 5, wherein in response to the at least one bearing assembly being disposed in the raised position, the starter block supported by the bearing assembly is movable in two orthogonal axes relative to the platform in response to forces along either axis of a first value, wherein in response to the at least one bearing assembly being disposed in the lowered position, the starter block is supported by the starter block support surface and is not movable in the two orthogonal axes relative to the platform in response to forces along either axis of the first value.

7. The continuous casting mold alignment system of claim 1, further comprising a clamp engaging the starter block, wherein in response to the at least one bearing assembly being moved to the lowered position, the clamp applies a force to the starter block, wherein in response to application of force from the clamp, a force of the starter block against the support surface is greater than a weight of the starter block.

8. The continuous casting mold alignment system of claim 1, wherein the at least one of the continuous casting mold and the starter block comprises the continuous casting mold, wherein the at least one bearing assembly is supported by the mold frame, wherein the at least one bearing assembly, in the raised position, engages and supports the mold, wherein the mold is movable relative to the starter block for alignment of the mold with the starter block.

9. The continuous casting mold alignment system of claim 8, wherein the bearing assembly comprises a clamping block, wherein in response to the bearing assembly moving from the raised position to the lowered position, the clamping block secures the continuous casting mold to the mold frame.

10. The continuous casting mold alignment system of claim 9, wherein in response to the bearing assembly being in the raised position, the continuous casting mold is movable in two orthogonal directions in response to forces in the two orthogonal directions of a first value, wherein in response to the bearing assembly being in the lowered position, the continuous casting mold is not movable in the two orthogonal directions in response to forces in the two orthogonal directions of the first value.

11. A method of aligning a continuous casting mold with a starter block comprising:

advancing at least one bearing assembly to a raised position with a lifting mechanism, wherein the at least one bearing assembly, in the raised position, engages and supports one of the continuous casting mold within a mold frame or the starter block;

aligning the one of the continuous casting mold or the starter block with the other of the continuous casting mold or the starter block; and retracting the at least one bearing assembly to a lowered position with the lifting mechanism, wherein the at least one bearing assembly, in the lowered position, is disengaged from the one of the continuous casting mold or the starter block, wherein, in response to the one of the continuous casting mold or the starter block being engaged by and supported by the at least one bearing assembly, forces along two orthogonal directions below a first value move the one of the continuous casting mold or the starter block relative to the at least one bearing assembly, and wherein, in response to the one of the continuous casting mold or the starter block being disengaged by the at least one bearing assembly, forces along two orthogonal directions below the first value do not move the one of the continuous casting mold or the starter block relative to the at least one bearing assembly.

12. The method of claim 11, wherein aligning the one of the continuous casting mold or the starter block with the other of the continuous casting mold or the starter block comprises:

moving the one of the continuous casting mold or the starter block along two orthogonal directions relative to the other of the continuous casting mold or the starter block.

13. The method of claim 12, wherein moving the one of the continuous casting mold or the starter block along two orthogonal directions relative to the other of the continuous casting mold or the starter block is performed by an alignment guide arranged between the starter block and the continuous casting mold.

14. The method of claim 11, further comprising:

clamping the one of the continuous casting mold or the starter block in a secured position in response to retracting the at least one bearing assembly to the lowered position.

15. The method of claim 14, wherein the one of the continuous casting mold or the starter block is the continuous casting mold, and wherein clamping the continuous casting mold in the secured position in response to retracting the at least one bearing assembly to the lowered position comprises clamping the continuous casting mold to a mold frame.

16. The method of claim 14, wherein the one of the continuous casting mold or the starter block is the starter block, and wherein clamping the starter block in the secured position in response to retracting the at least one bearing assembly to the lowered position comprises clamping the starter block to a platform in a casting pit of a continuous casting mold system.

17. An alignment system for aligning a starter block with a continuous casting mold supported by a mold frame, the alignment system comprising:

a bearing assembly comprising at least one bearing having a bearing surface;

a lifting mechanism, wherein the lifting mechanism is configured to move the bearing assembly between a lowered position in which the bearing surface is recessed below a support surface and a raised position in which the bearing surface is proud of the support surface; and a clamping mechanism configured to secure one of a starter block or a continuous casting mold to a starter block support surface or a mold frame, respectively.

18. The alignment system of claim 10, wherein the lifting mechanism comprises a pneumatic cylinder.

19. The alignment system of claim 17, wherein the bearing assembly, in the raised position, is configured to support the starter block and enable the starter block to be moved relative to the continuous casting mold with a force substantially lower than a force required with the bearing assembly in the lowered position.

20. The alignment system of claim 17, wherein the bearing assembly, in the raised position, is configured to support the continuous casting mold and enable the continuous casting mold to be moved relative to the starter block with a force substantially lower than a force required with the bearing assembly in the lowered position.

* * * * *